United States Patent [19]

Blickstein

[11] Patent Number: 4,620,169

[45] Date of Patent: Oct. 28, 1986

[54] MAGNETICALLY TUNABLE DIELECTRIC RESONATOR HAVING A MAGNETICALLY SATURABLE SHIELD

[75] Inventor: Martin J. Blickstein, Austell, Ga.

[73] Assignee: Murata Erie N.A., Inc., Smyrna, Ga.

[21] Appl. No.: 719,982

[22] Filed: Apr. 4, 1985

[51] Int. Cl.[4] ..... H01P 7/10

[52] U.S. Cl. ..... 333/235; 333/219; 333/205

[58] Field of Search ..... 333/202, 219, 235, 205; 331/99, 107 DP, 107 SL, 117 D

[56] References Cited

U.S. PATENT DOCUMENTS

| | | | |
|---|---|---|---|
| 2,890,422 | 6/1959 | Schlicke | 333/77 |
| 3,766,494 | 10/1973 | Anbe et al. | 331/99 |
| 3,798,578 | 3/1974 | Konishi et al. | 333/202 X |
| 4,096,461 | 6/1978 | Roschmann | 335/209 |
| 4,122,418 | 10/1978 | Nagao | 333/219 |
| 4,484,162 | 11/1984 | Kamada et al. | 333/219 |

FOREIGN PATENT DOCUMENTS

| | | | |
|---|---|---|---|
| 0117310 | 9/1980 | Japan | 331/117 D |

OTHER PUBLICATIONS

Resomics Microwave Ceramics Design Manual No. 58-04; 1983 Murata Erie N.A., Inc.

*Primary Examiner*—Eugene R. LaRoche
*Assistant Examiner*—Benny T. Lee
*Attorney, Agent, or Firm*—Thomas & Kennedy

[57] ABSTRACT

A dielectric resonator 11 is tuned by varying the magnetic flux induced into a magnetically saturable shield 12 mounted adjacent the resonator by varying the flow of current through a coil 17.

4 Claims, 8 Drawing Figures

MAGNETICALLY TUNABLE DIELECTRIC RESONATOR HAVING A MAGNETICALLY SATURABLE SHIELD

TECHNICAL FIELD

This invention relates generally to dielectric resonators, and particularly to means for tuning them.

BACKGROUND OF THE INVENTION

Dielectric resonators are formed of bodies of low loss, temperature stable, high permittivity, slab-like ceramic bodies. They are resonately responsive to specific electrical frequencies of current carried by adjacent circuit conductive elements. Their resonant frequency is dependent upon their shape, size, proximity to adjacent circuit elements and the dielectric constant of the body forming the resonator which exceeds that of the surrounding environment.

Insomuch as it is impractical to provide a multitude of dielectric resonators of diverse sizes and shapes for selective incorporation into circuits, dielectric resonators have been provided with means for tuning their frequency of resonant response after they have been built into circuits. Heretofore, such resonators have been tuned or trimmed by providing a positionally adjustable, low impedence element in close proximity with the body of dielectric material. For example, in U.S. Pat. No. 2,890,422 a metallic trimmer disc is positioned closely adjacent a dielectric resonator and mechanically reoriented with respect to the resonator for tuning its resonant frequency. As disclosed by this same patent, tuning may also be accomplished by imposing a magnetic bias on the dielectric resonator which bias may be adjusted by altering the electric current passing through a coupling coil.

Coils for generating magnetic fields of varying flux density have also been used for tuning resonant frequencies of ferrite type resonators, as disclosed in U.S. Pat. No. 3,766,494, and for tuning YIG oscillators and filters as shown in U.S. Pat. No. 4,096,461. Nevertheless, today dielectric resonators are probably still most commonly tuned by mechanical relocation of adjacent elements as exemplified by U.S. Pat. No. 4,484,162 which issued in Nov. 20, 1984.

With today's microminiaturization of electronic circuits, the use of mechanically adjustable means for tuning dielectric resonators has become increasingly impractical. The sizes of the various conductive elements of microstrip circuits, for example, are simply too small to include such. Accordingly, more than ever a need exists for dielectric resonators with tuning means that do not necessitate the use of mechanically relocatable or adjustable elements. Thus, it is to the provision of a tunable dielectric resonator that does not require the use of such movable elements that the present invention is primarily directed.

SUMMARY OF THE INVENTION

In one form of the invention a magnetically tunable resonator comprises a dielectric resonator, a magnetically saturable shield mounted adjacent the dielectric resonator, and means for inducing magnetic flux of variable flux densities into the magnetically saturable shield for tuning the resonator by effectively changing its electromagnetic dimensions.

In another form of the invention, a magnetically tunable dielectric resonator comprises a support, a magnetically saturable shield mounted adjacent one side of the support, and a ceramic microwave resonator mounted adjacent a side of the shield distal the support. The resonator also includes means for inducing magnetic flux of variable flux densities into the shield for resonant frequency tuning.

In another form of the invention a method of tuning a dielectric resonator comprises the steps of positioning a magnetically saturable shield adjacent the resonator, inducing magnetic flux into the shield, and varying the density of the induced magnetic flux induced into the shield.

BRIEF DESCRIPTION OF THE DRAWING

FIG. 3A is a schematic view of another magnetically tunable dielectric resonator embodying principles of the invention while

DETAILED DESCRIPTION

Figure 1A:
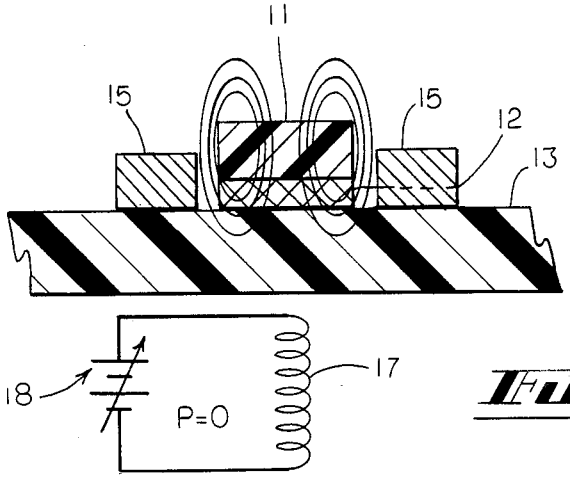
FIGS. 1A–1C illustrate a magnetically tunable dielectric resonator embodying principles of the present invention at three differently tuned conditions.
Figure 1B:
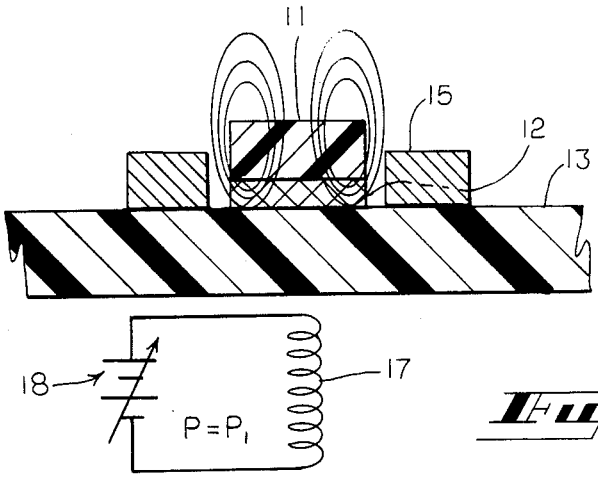
Figure 1C:
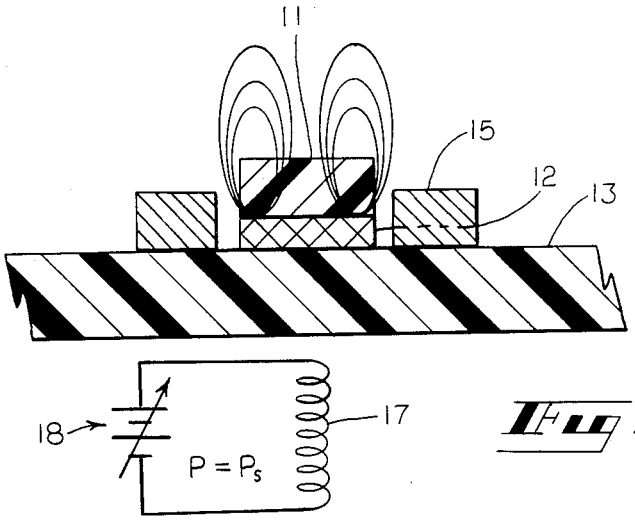

With reference next to FIGS. 1A–1C of the drawing, a magnetically tunable resonator is shown having a cylindrical block or body of dielectric material 11 mounted upon a magnetically saturable shield 12 which shield is in turn mounted upon a dielectric support strip or substrate 13. The dielectric body 11, which may, of course, be of other shapes, is formed of a conventional low microwave loss, temperature stable, high permittivity and high Q ceramic. The magnetically saturable shield is also conventionally formed of a high Q, low loss ceramic. A pair of extrinsic, conductive circuit elements 15 is shown mounted upon the support strip 13 to each side of the ceramic body 11. An electrical coil or inductor 17 is shown located beneath the substrate 13 axially aligned with the cylindrical, ceramic body 11. A variable d.c. power supply 18 is coupled with the coil to provide a variable d.c. voltage thereacross. Alternatively, an a.c. source of variable amplitude may be employed.

In FIG. 1A the coil is in a no voltage condition and thus with no magnetic field being generated by it. In this condition the saturable shield 12 is magnetically transparent and the external magnetic field of the resonator is determined only by the passive geometric environment in which it is incorporated. The resonate frequency of the resonator is therefore determined by this boundary condition. In FIG. 1B the voltage supply is producing a power level $P_1$ so that the coil 13 generates magnetic field in the saturable shield. This biased condition of the saturable shield alters the geometry of flux penetration in the dielectric resonator body 11 thereby changing the apparent geometry of its boundary condition. In other words, its electromagnetic dimensions have been effectively changed.

In FIG. 1C the power supply 18 is generating power $P_s$ which is sufficient to have the coil 17 produce a flux density within the magnetic shield sufficient to cause it to go to saturation. For this condition the shield 12 becomes inpenetrable thus effectively decoupling the resonator body 11 from the mounting substrate entirely.

The magnetic force field lines illustrated in FIGS. 1A-1C, which are originated by electric current passing through the conductors 15, schemtically show how the varying conditions just described within the dielectric resonator cause it to be tunable by alterations in the power output of the variable power supply 18. This voltage change may, of course, be conventionally done in numerous ways without the use of movable elements.

Figure 2A:
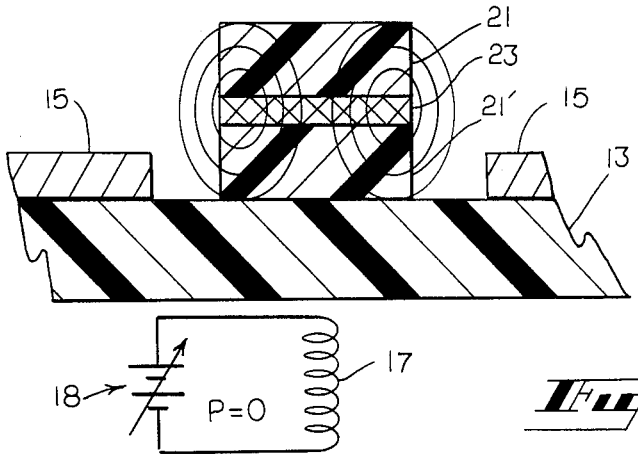
FIGS. 2A–2C schematically illustrate a magnetically tunable dielectric resonator embodying principles of the invention in another form shown at three differently tuned conditions.
Figure 2B:
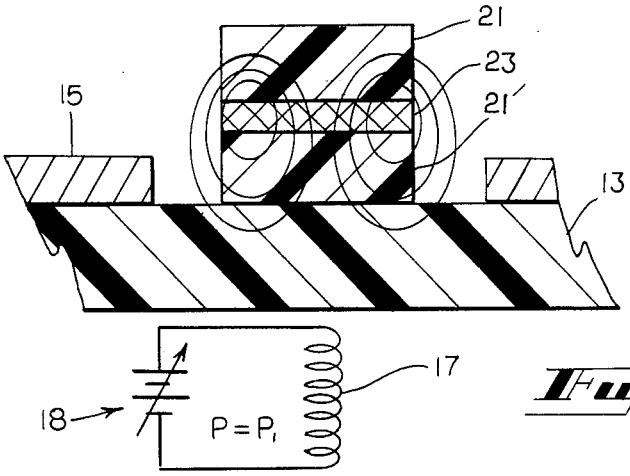
Figure 2C:
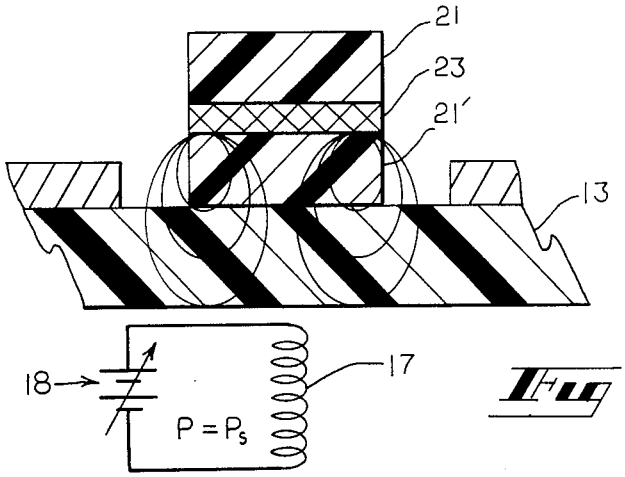

In the just described embodiment of the apparent boundary conditions of the dielectric resonator are altered as a means for achieving resonate tuning. In FIGS. 2A-2C instead of the apparent boundary condition being changed the apparent geometry of the dielectric resonate body itself is altered as a tuning technique. This achieves tuning since the height-to-diameter ratio of a dielectric resonate body is a major frequency determinate. For example, with a resonator dielectric body height of 4.77 mm and a diameter of 10.75 mm for a cylindrically shaped dielectric body, the ratio of height to diameter is 0.44 and the nominal operating frequency is 4.9 $GH_z$. If the height is drawn down to 3.76 mm (i.e., the ratio is now 0.35) the resonator operates in the same environment at 5.39 $GH_z$. Thus, the embodiment of FIGS. 2A-2C may accomplish this geometric modification magnetically. In FIGS. 2A-2C a split-body resonator is shown having bodies of cylindrical dielectric material 21 and 21' of the same size and shape mounted axially aligned to opposite sides of a magnetically saturable shield 23. The dielectric body 21' is mounted upon a dielectric support or substrate 13. Again, a coil 17 is shown mounted beneath the substrate 13 aligned with the dielectric bodies 21, 21' with the coil being coupled with a variable DC power supply 18. Extrinsic conductor elements 15 are also mounted to the substrate.

In FIG. 2A the power supply is providing no voltage across the coil. Thus, the shield 23 is magnetically transparent with no magnetic bias provided by the coil. The magnetic force field lines are schmetrically indicated within the split body resonator. In actuality they would be uniformly distributed all around its outer periphery.

As magnetic bias is applied by the impression of voltage across coil 17, there is an apparent shift in the magnetic field induced by the current flow in the adjacent conductors 15 into the resonator. Thus, in FIG. 2B the magnetic field has shifted as shown as shield 23 becomes partially saturated. Thus, as the shield becomes increasingly opaque, the physical dimensions of the magnetic circuit become increasingly limited to one of the split resonator bodies.

In FIG. 2C the power supply 8 has now caused the coil 17, in effect, to decouple the dielectric body 21 from the dielectric body 21'. The geometry of the dielectric body as a whole has apparently been changed without actually having changed any of the real physical geometries of the various elements. Therefore, the apparent height to diameter ratio of the split body has been altered as a means of tuning the resonator.

Figure 3A:
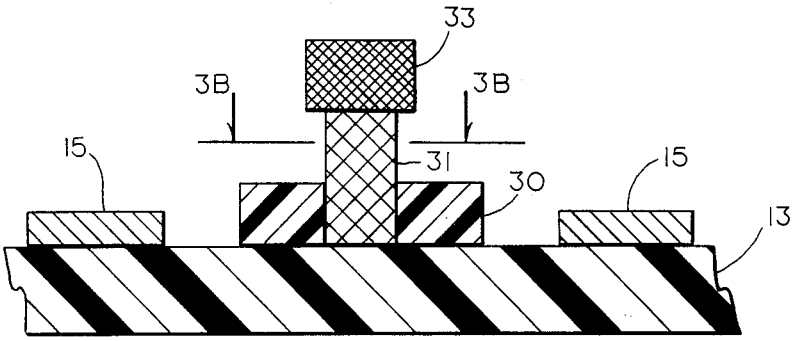
Figure 3B:
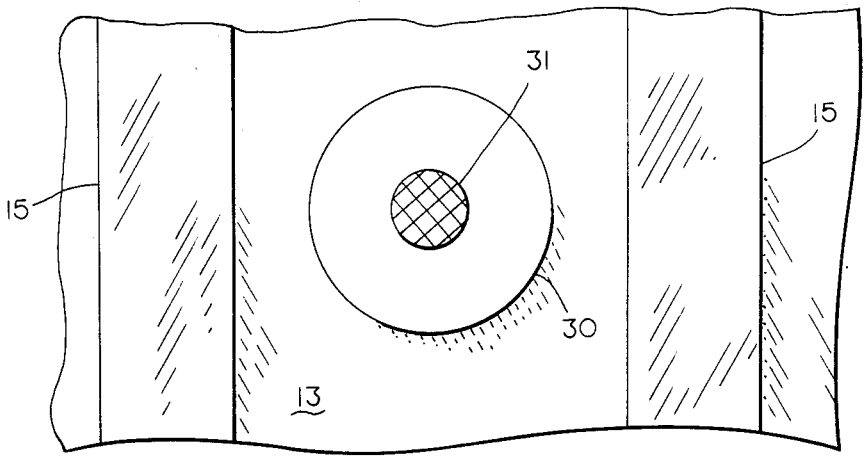
FIG. 3B is a plan view of it taken in section equivalent along plane 3B—3B.

In FIGS. 3A and 3B yet another embodiment is shown wherein a cylindrical dielectric resonator 30 is formed with a central hole in which a cylindrically shaped mangetically saturable shielding core 31 is situated atop a substrate 13. A biasing coil 33 is mounted atop the shield core 31. Here too the biasing coil acts to bias the shielding core. It is powered by an unshown controllabe power source such as a battery.

It thus is seen that a magnetically tunable dielectric resonator is now provided with overcomes problems and limitations associated with those of the prior art. It should, however, be understood that the just described embodiments merely illustrate principles of the invention in three preferred forms. Many other modifications, additions and deletions may, of course, be made thereto without departure from the spirit and scope of the invention as set forth in the following claims.

I claim:

1. A magnetically tunable dielectric resonator comprising a support, a magnetically saturable shield mounted adjacent one side of said support, a ceramic microwave resonator mounted to a side of said shield facing away from said support, means for inducing magnetic flux of variable flux densities into said shield for resonant frequency tuning, and a second ceramic microwave resonator mounted between said support and said shield.

2. The dielectric resonator of claim 1 wherein said ceramic microwave resonator and said second ceramic microwave resonator have substantially the same size and shape.

3. A magnetically tunable resonator comprising, in combination, first and second dielectric resonators mounted adjacent to a substrate with said second dielectric resonator located between said first dielectric resonator and said substrate, a magnetically saturable ceramic shield mounted between said first and second dielectric resonators, and means for inducing magnetic flux of variable flux densities into said magnetically saturable shield thereby for tuning the resonator by effectively changing the electromagnetic dimensions of the first and second dielectric resonators by altering the geometry of flux penetration in the first and second dielectric resonators.

4. The magnetically tunable resonator of claim 3 wherein said first dielectric resonator and said second dielectric resonator have substantially the same size and shape.

* * * * *